US006647978B1

(12) United States Patent
Khosropour et al.

(10) Patent No.: US 6,647,978 B1
(45) Date of Patent: Nov. 18, 2003

(54) KITCHEN ISLAND VENT HOOD

(75) Inventors: Mostafa Michael Khosropour, Newton, IA (US); Roxanne Abul-Haj, Mesa, AZ (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/163,558

(22) Filed: Jun. 6, 2002

(51) Int. Cl.[7] ..... F24C 15/20
(52) U.S. Cl. ..... 126/299 R; 126/299 D
(58) Field of Search ..... 126/299 R, 299 D, 126/300, 312, 301; D23/365, 372; 454/63; 55/DIG. 36

(56) References Cited

U.S. PATENT DOCUMENTS

| | | | | | |
|---|---|---|---|---|---|
| 2,554,694 | A | * | 5/1951 | Belt | 126/299 R |
| 2,674,991 | A | | 4/1954 | Schaefer | |
| 2,974,663 | A | * | 3/1961 | Humbert | 126/299 R |
| 3,011,492 | A | | 12/1961 | Humbert | |
| 3,031,946 | A | | 5/1962 | Watt et al. | |
| 3,391,689 | A | * | 7/1968 | Roger | 126/299 R |
| 3,409,005 | A | | 11/1968 | Field | |
| 4,446,849 | A | | 5/1984 | McFarland | |
| 4,501,260 | A | * | 2/1985 | Grace | 126/299 R |
| 4,934,337 | A | | 6/1990 | Falk | |
| 5,020,511 | A | | 6/1991 | Liu | |
| 5,427,570 | A | | 6/1995 | Chen | |
| D434,486 | S | * | 11/2000 | Segers | D23/372 |
| 6,276,358 | B1 | | 8/2001 | Brin, Jr. et al. | |

FOREIGN PATENT DOCUMENTS

| | | | | | |
|---|---|---|---|---|---|
| BE | 557775 | | * | 7/1957 | 126/299 R |
| DE | 3503236 | | * | 8/1986 | 126/299 D |
| DE | 2619198 | | * | 2/1989 | 126/299 R |
| FR | 2730040 | A1 | * | 8/1996 | 126/299 R |
| JP | 62-288436 | | | 6/1986 | |
| JP | 3-17455 | | * | 1/1991 | 126/299 D |

OTHER PUBLICATIONS

Gaggenau "We Get To The Source Of The Problem" VL 051 Cooktop ventilator.

* cited by examiner

*Primary Examiner*—James C. Yeung
(74) *Attorney, Agent, or Firm*—McKee, Voorhees & Sease, P.L.C.

(57) ABSTRACT

A kitchen island vent hood is provided which telescopes upwardly and downwardly and extends forwardly and rearwardly for use between operative and non-operative positions. In the non-operative position, the vent hood resides within a recessed area of the island, at a level slightly above the countertop of the island. The lift column of the vent hood assembly extends at approximately a 15° from vertical so as to position the vent hood over the cooking surface. The vent hood moves forwardly so as to cover the cooking surface and moves rearwardly for storage in the island recess.

23 Claims, 11 Drawing Sheets

KITCHEN ISLAND VENT HOOD

BACKGROUND OF THE INVENTION

Kitchen islands are common and popular, and often include a gas or electric stove top for cooking. Such an island stove top presents problems with venting, since the island sits in the open area of the kitchen, apart from any walls. Prior art venting for islands generally comes in two forms, upward and downward venting. Upward venting involves a hood at the lower end of a column hanging from the ceiling. The hood captures rising hot air carrying grease, steam, smoke, and/or odors, and vents them upwardly through a duct extending through the hanging column. In order to be effective, such hanging hoods must extend to a height approximately 28–30 inches above the cooking surface. However, at this elevation, the hood obstructs view across the kitchen and from one side of the island to the other.

Downward venting systems typically include a panel which extends or pops up from the island a short distance and draws air laterally across the cooking surface for expulsion through a duct extending downwardly into the island. However, since hot air naturally rises, such downward venting systems are inefficient and allows substantial portions of grease, steam, smoke and/or odors to escape into the ambient kitchen air.

Another type of venting system is disclosed in Applicant's U.S. Pat. No. 6,276,358, which discloses a pop-up table top with vent hoods that can be extended and retracted so as to overlay a portion of the cooking surface. A similar pop-up column with a swivel vent hood is offered for sale by Gaggenau under the tradename V1051 Cook-Top Ventilator, which has a hood extending over a portion of the cooking surface. In both the Gaggenau system and the system of U.S. Pat. No. 6,276,358, the vent hoods are relatively small and do not cover all of the cooking surface. Therefore, these ventilation systems are not efficient in capturing rising air from cooking areas beyond the reach of the small hoods.

Therefore, a primary objective of the present invention is the provision of an improved kitchen island vent hood.

Another objective of the present invention is the provision of an island vent hood which extends over substantially the entire cooking area to capture grease, steam, smoke and/or odors.

A further objective of the present invention is the provision of an island vent hood which is retractable into the island when not in use and extensible over the entire cooking surface when in use.

Still another objective of the present invention is the provision of an improved island vent hood which can be positioned at various heights above the cooking surface and which can also be horizontally positioned overall or a portion of the cooking surface.

Still another objective of the present invention is the provision of an island vent hood which is efficient and durable in use, and economical to manufacture.

These and other objectives will become apparent from the following description of the invention.

SUMMARY OF THE INVENTION

An improved vent hood is provided for an island cooking surface. The vent hood is mounted on an extensible and retractable column so as to be retracted into a recess in the island structure when not in use, and is extensible to a height up to 30 inches above the cooking surface when in use. The column extends from a position in the island rearwardly of the cooking surface, preferably at an angle of approximately 15° from vertical. The vent hood slides horizontally from a forward position covering the cooking surface to a retracted position for receipt in the island recess when not in use. Separate actuators control the raising and lowering of the column and the extension and retraction of the vent hood relative to the column. The movement of the vent hood actuator is amplified by linkages so as to maximize the extension of the vent hood with minimal space requirements for the actuator.

DETAILED DESCRIPTION OF THE INVENTION

Figure 1:
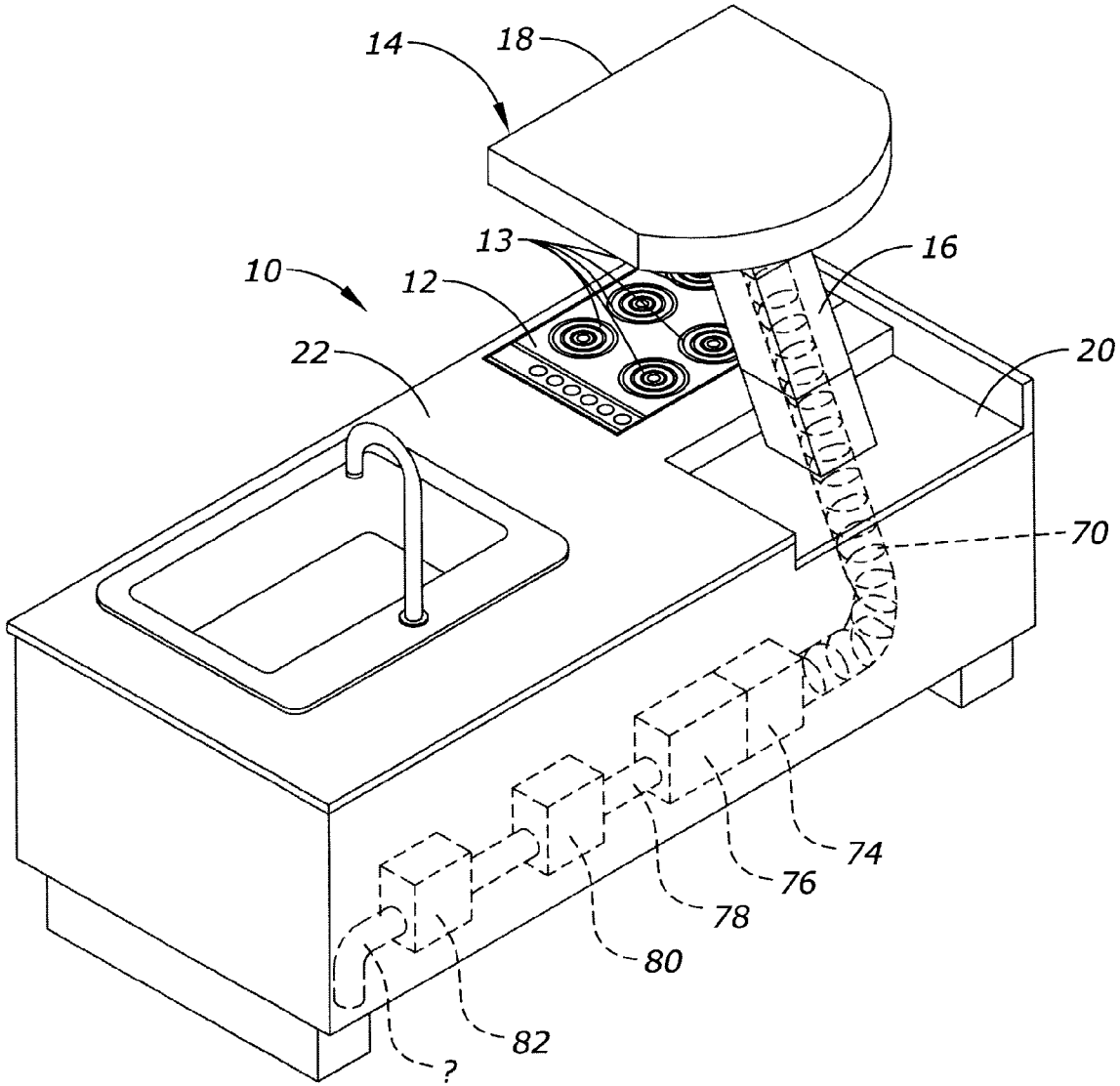
FIG. 1 is a perspective view of the improved island vent hood of the present invention.

A kitchen island is generally designated by the reference numeral 10 in the drawings. The island includes a stovetop or cooking surface 12 and the vent hood assembly 14 of the present invention. The assembly 14 includes a telescoping lift column 16 with a retractable and extendable vent hood 18 mounted on top of the column 16. As seen in FIG. 1, the assembly 14 extends upwardly in the operative or use position from a recessed area 20 in the island 10. In the non-use or storage position, the assembly 14 resides within the recess 20. Preferably, when the assembly 14 is lowered and retracted into the recess 20, the top of the vent hood 18 is slightly above the countertop 22 of the island 10, so as to discourage the setting of an object on the edge of the vent hood where the object could fall off or spill when the assembly 14 is raised. Alternatively, the top of the vent hood 18 can be flush with the countertop 22 when the assembly 14 is in the storage position.

Figure 2:
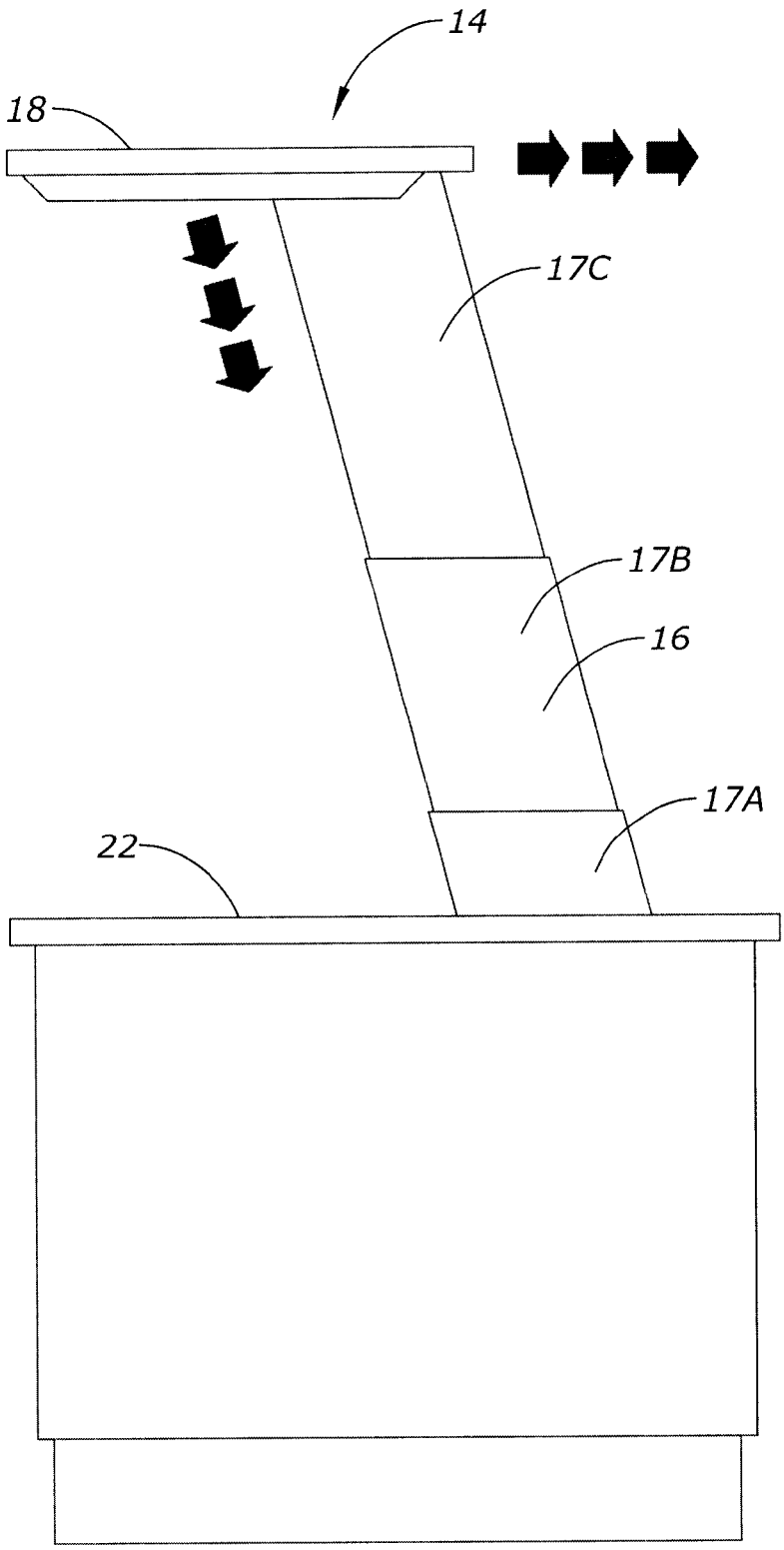
FIG. 2 is a side elevation view of the island vent hood of the present invention.

As seen in FIGS. 1 and 2, the column 16 preferably extends at a non-perpendicular angle relative to the cooking surface 12. The angle is in the range of 10°–20° from vertical, with a preferred angle of 15°.

Figure 3:
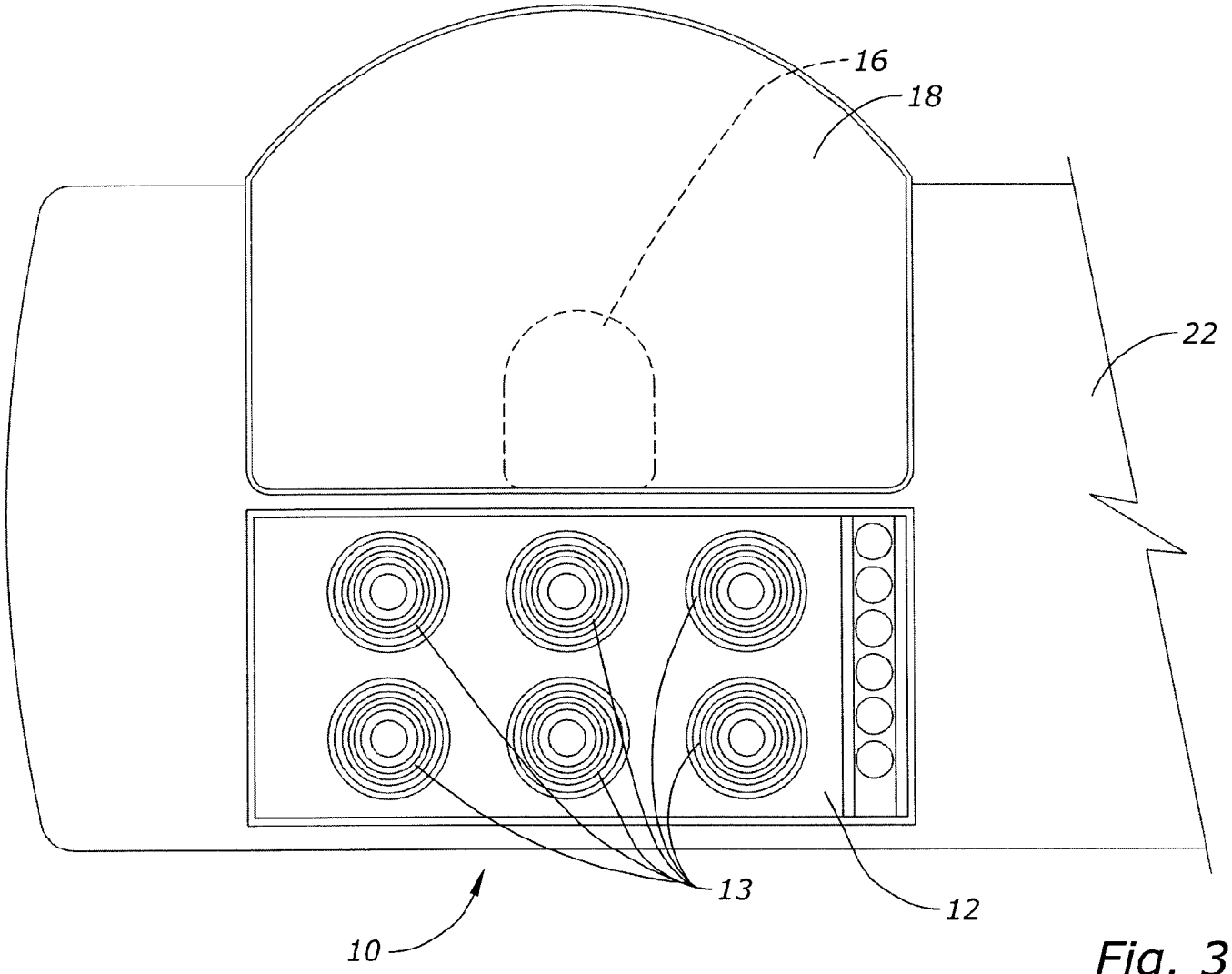
FIG. 3 is a top plan view of the island vent hood of the present invention.
Figure 4:
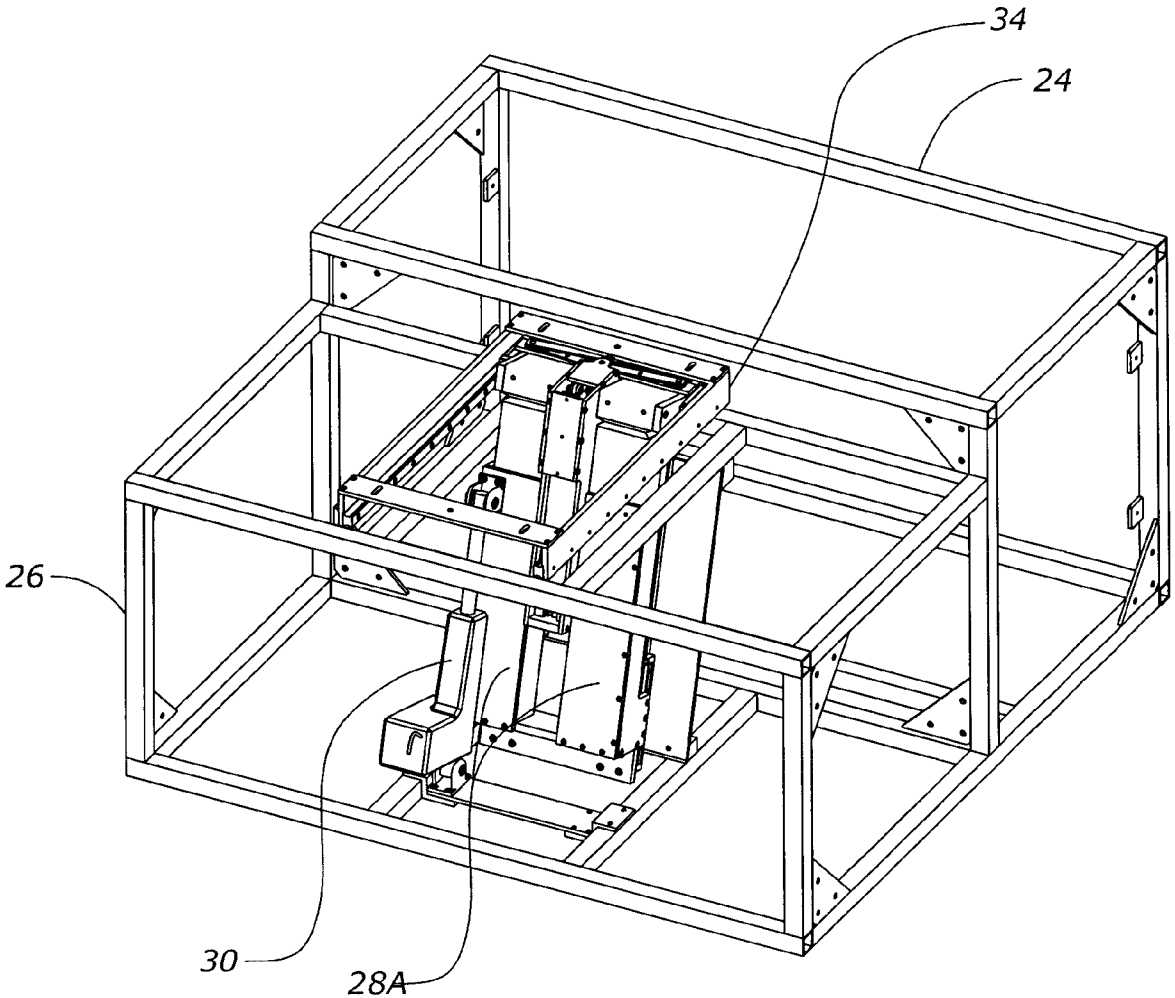
FIG. 4 is a perspective view of a portion of the island framework with the frame assemblies of the vent hood and column in a retracted or storage position.
Figure 5:
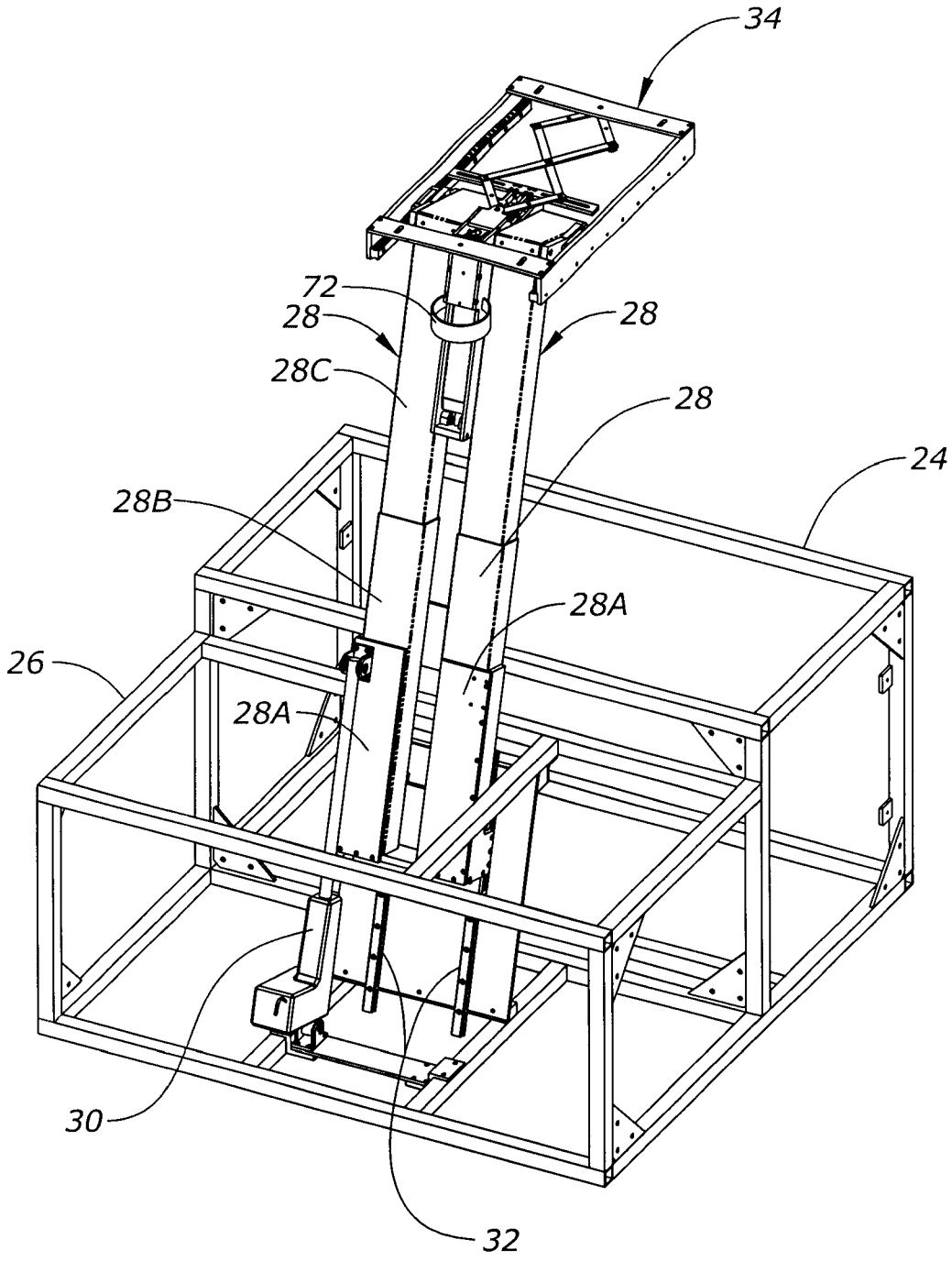
FIG. 5 is a view similar to FIG. 4 showing the column and vent hood frames in fully extended positions.

The vent hood 18 is mounted on the column 16 so as to be horizontally movable between a retracted position, shown in FIG. 3, and an extended position, shown in FIGS. 1 and 2. The angular orientation of the column 16 allows the vent hood 18 to be positioned fully over the cooking surface 12 with less forward movement, as compared to a vertical column. While it is understood that the column 16 may be oriented vertically, such a vertical orientation would require a greater extension of the vent hood 18 for positioning over the cooking surface 12.

FIGS. 4–10 show the frame structures for a portion of the island 10, the column 16, and the vent hood 18. More particularly, the island 10 includes a forward frame portion 24 which supports the stovetop or cooking appliance which defines the cooking surface 12. The island 10 also includes a shorter rearward frame portion 26 which defines 15 the recessed area 20 of the island 10.

The mechanical structures of the assembly 14 are mounted in the rearward frame portion 26 of the island 10 as shown in FIGS. 4–7. The column 16 includes a pair of spaced apart frame members 28 with telescoping sections. The frame members 28 are connected so that they are raised and lowered in unison. It is understood that a single telescoping frame member could be provided, though it is preferred to use the dual frame members 28 which provide increased lateral stability for the vent hood 18.

Figure 6:
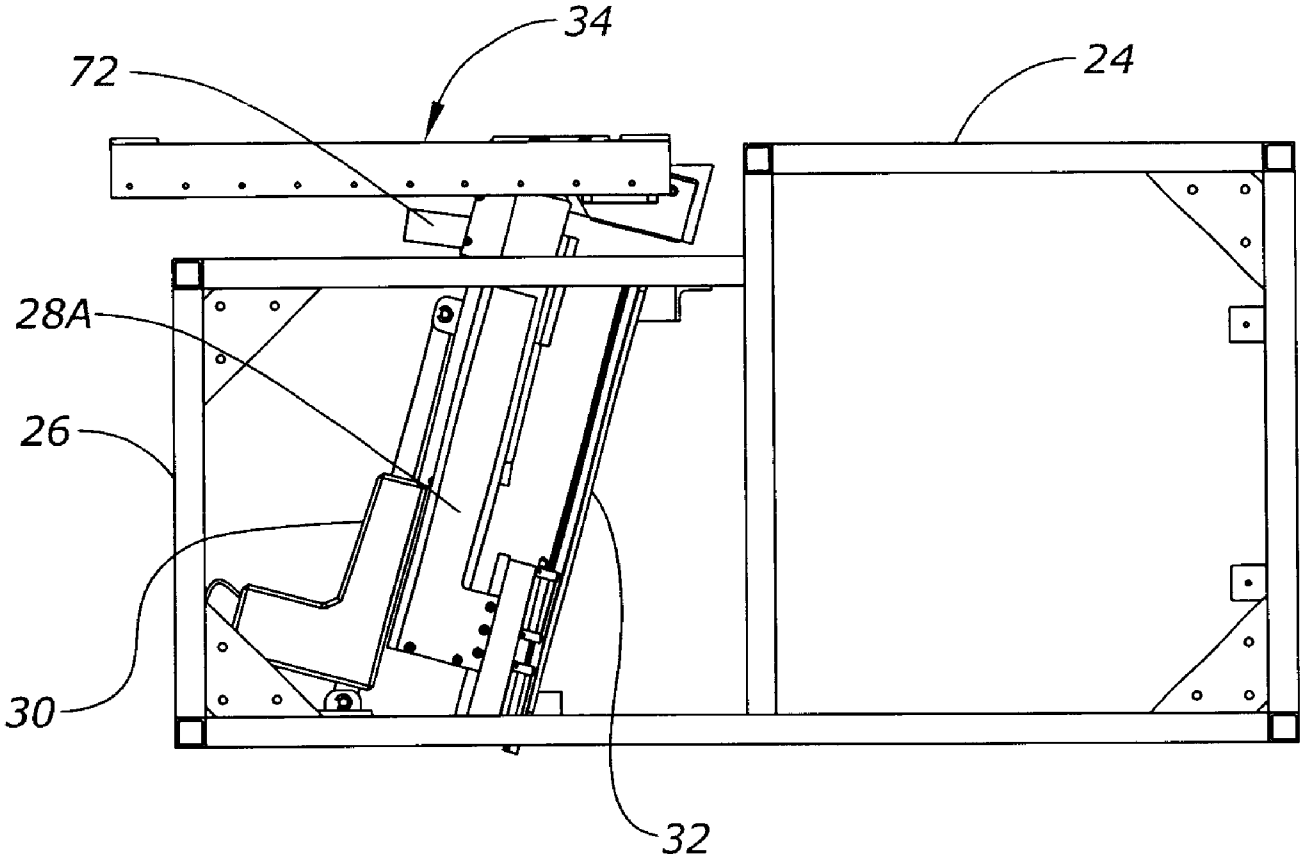
FIG. 6 is a side elevation view of the frame structures shown in FIG. 4 in the retracted positions.
Figure 7:
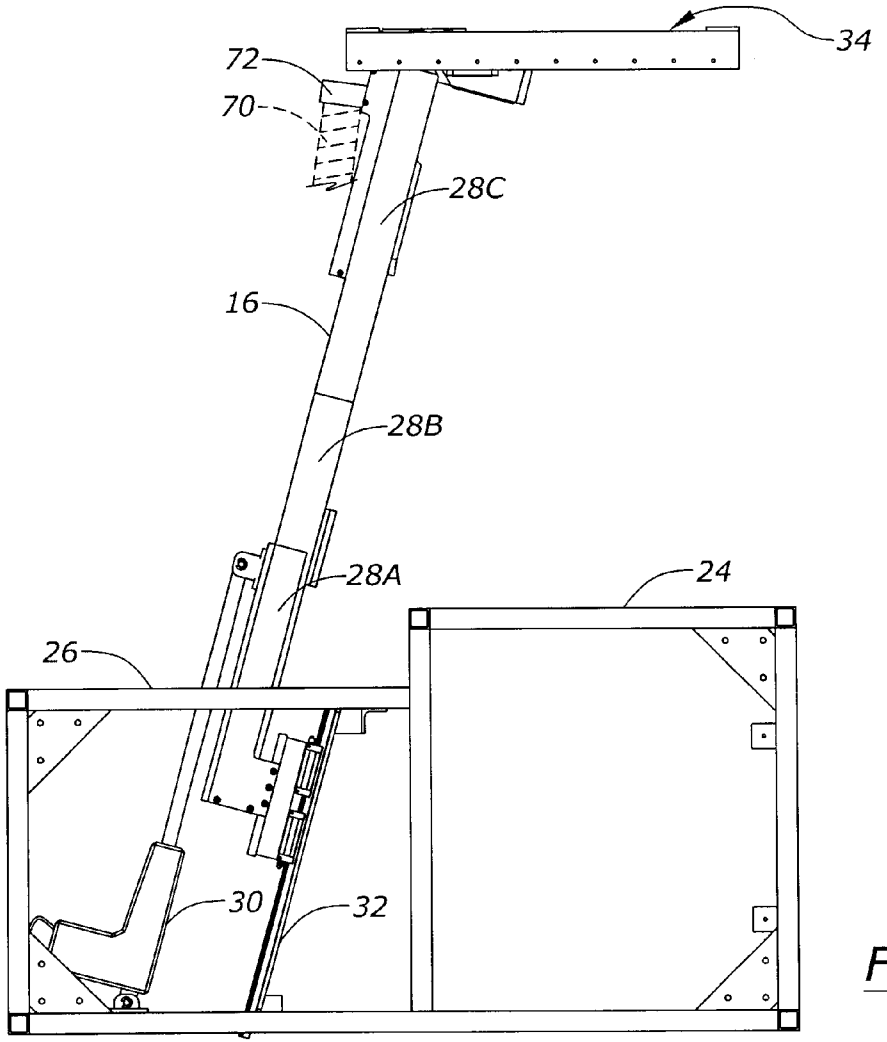
FIG. 7 is a side elevation view of the frame structures shown in FIG. 5 in the fully extended positions.
Figure 8:
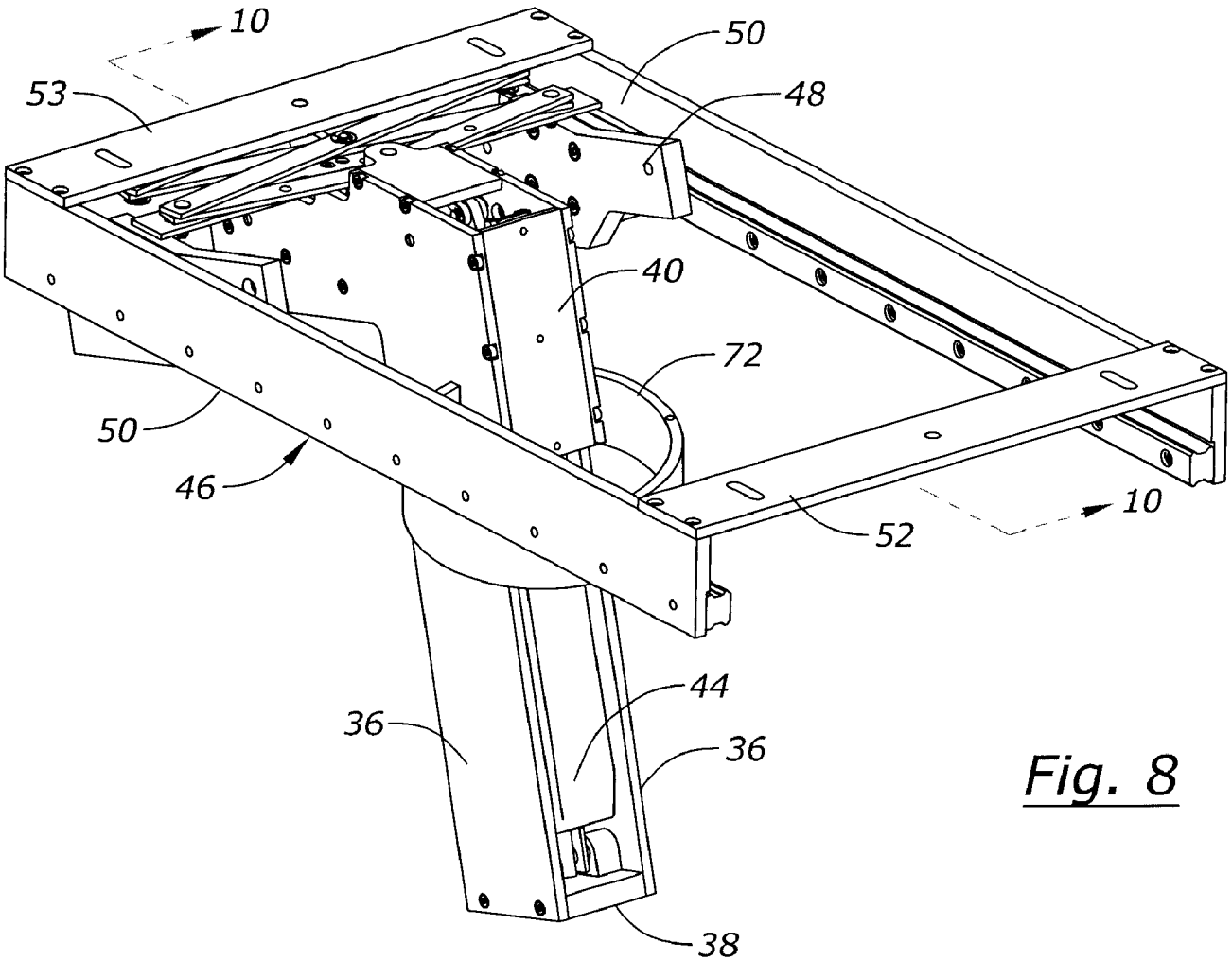
FIG. 8 is an enlarged perspective view of the vent hood frame structure in a retracted position.
Figure 9:
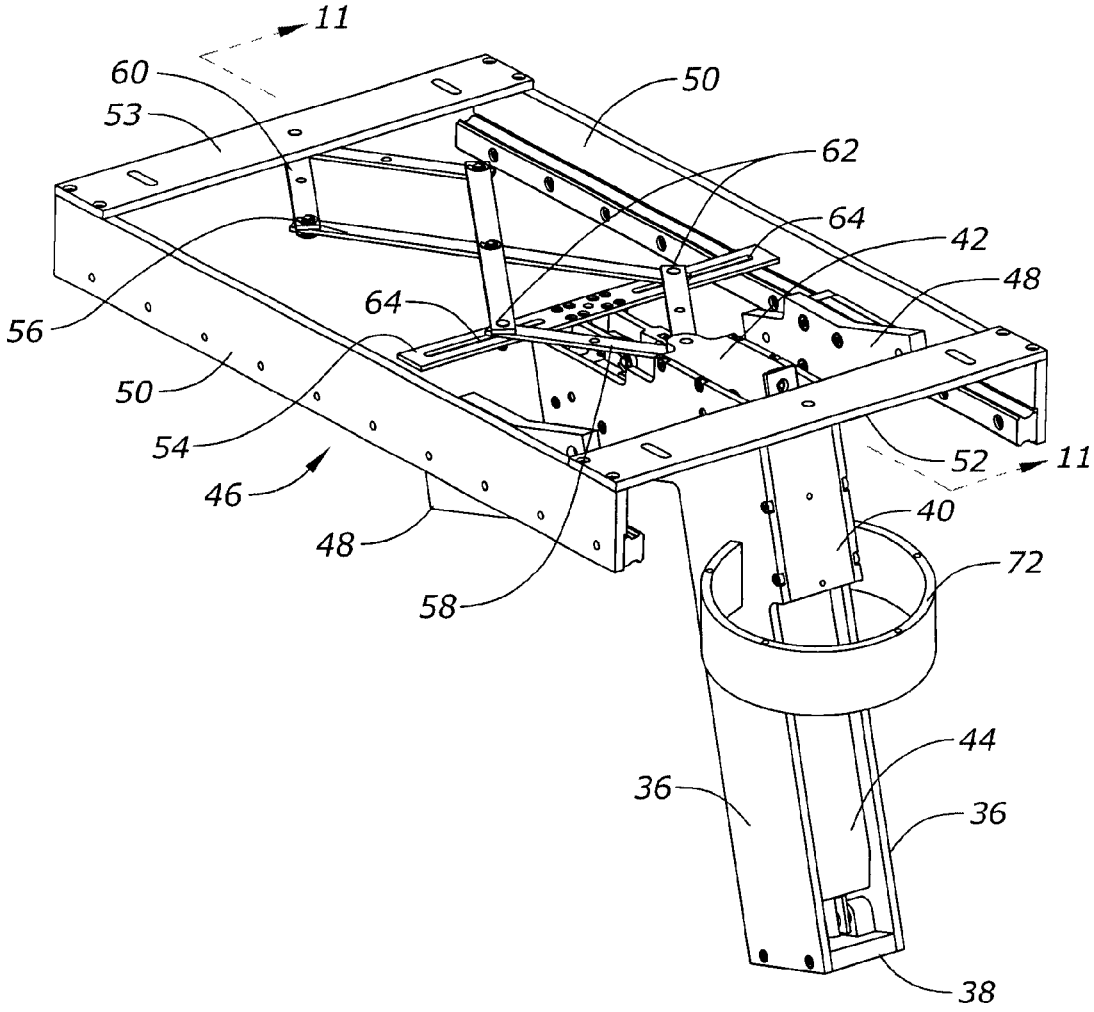
FIG. 9 is a view similar to FIG. 8 showing the vent hood frame structure in an extended position.

As best seen in FIGS. 6 and 7, an actuator 30, such as a motor driven screw, has a lower end connected to the rearward frame 26 of the island 10 and an upward end connected to the base 28A of the column frames 28. The bases 28A of the column frames 28 are mounted for sliding movement along rails 32 in the rearward frame 26 of the island 10. The angle of orientation of the rails 32 determines the angle of the column 16, preferably 15° from vertical. As seen in FIG. 6, when the actuator 30 is retracted, the bases 28A of the column frames 28 are at the bottom of the rails 32, and when the actuator 30 is extended, as shown in FIG. 7, the bases 28A of the column frames 28 are at the top of the rails 32.

The telescoping frame sections 28A, B and C of the column 16 are enclosed by housing sections 17A, B, C, which also telescope with respect to one another.

The column frames 28 includes internal linear slides and actuators (not shown) for extending and retracting the telescoping frame sections 28B and 28C. The lift column frames 28 are commercially available from Linak of Denmark, Model DL3. These Linak lift columns extend more than two times their retracted height.

The actuator 30 and rails 32 define a first stage of the lift action for the vent hood assembly 14, while the internal actuators of the column frames 28 define a second stage of the lifting action.

Attached to the upper column section 28C is the frame assembly 34 for the vent hood 18. More particularly, a pair of plates 36 are secured between the upper column sections 28C, and are substantially L-shaped. A lower plate 38 is secured to the lower end of the plates 36. A backing plate 40 is secured to the rearward side of the plates 36 adjacent the upper end thereof. An upper plate 42 is secured to the top of the plates 36. The plates 36, 38, 40 and 42 define a sandwich structure which houses an actuator 44, as described in further detail below.

A horizontally disposed, rectangular subframe 46 is mounted to the upper end of the lift column frames 28 via mounting blocks 48. The subframe 46 is defined by opposite side slide rails 50 and cross bars 52, 53 secured at opposite ends of the slide rails 50. The slide rails 50 are attached to the mounting blocks 48. A slide bar 54 extends between the slide rails 50 and is adapted to slide there along. A retractable and extendable scissors mechanism 56 has a rearward end 58 connected to the upper plate 42 and a forward end 60 connected to the forward cross bar 52. The scissors 56 includes multiple joints, with the first joints 62 being slidably pinned or connected to elongated slots 64 in the slide bar 54.

Figure 10:
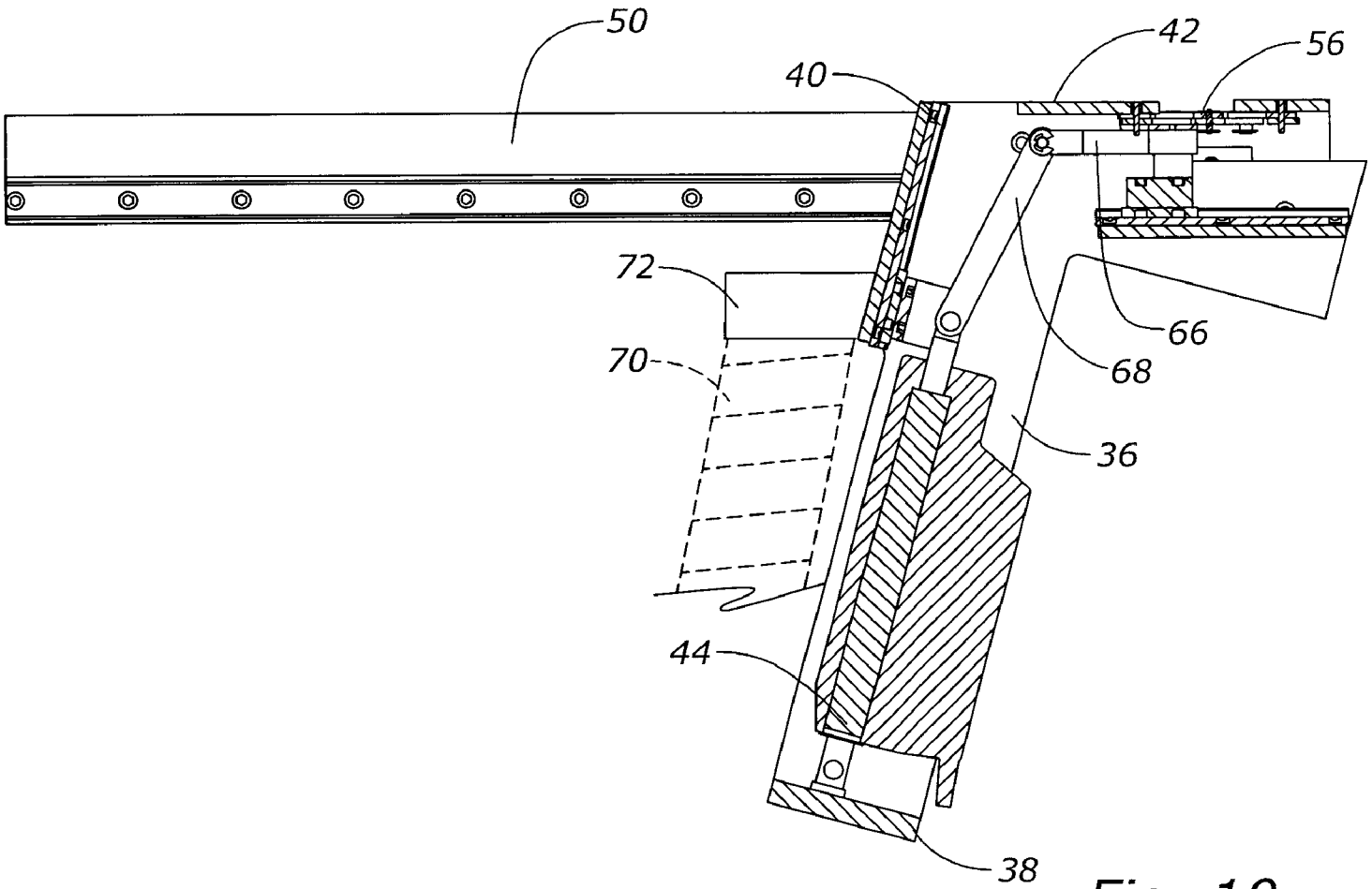
FIG. 10 is a sectional view of the vent hood frame structure taken along lines 10—10 of FIG. 8.
Figure 11:
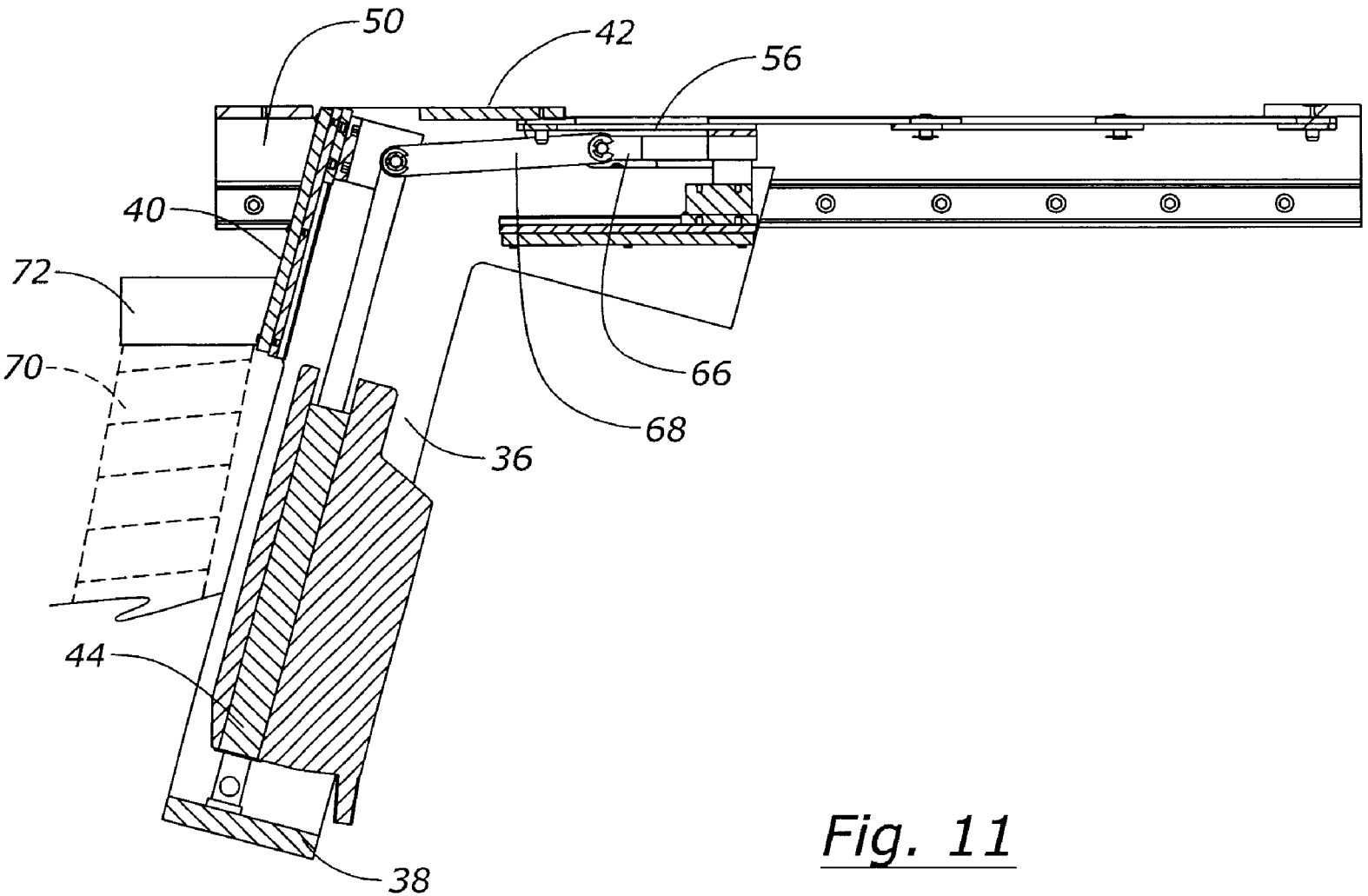
FIG. 11 is a sectional view of the vent hood frame structure taken along lines 11—11 of FIG. 9.

The slide bar 54 is connected to a rod 66, which in turn is pivotally connected to the upper end of a link arm 68. The lower end of the link arm 68 is connected to the upper end of the actuator 44, as best seen in FIGS. 10 and 11. The lower end of the actuator 44 is secured to the lower plate 38. When the actuator 44 is extended, the link arm 68 and connecting rod 66 translate the upward linear motion of the actuator 44 to horizontal linear motion so as to slide the slide bar 54 forwardly along the slide rails 50, while the scissors 56 simultaneously extend as the first joints 62 thereof move inwardly along the slots 64 of the slide bar 54. Thus, the slide bar 54 and scissors 56 translates a short linear extension of the actuator 44 into a substantially longer linear extension of the subframe 46 and the attached vent hood 18. Thus, the travel of the vent hood 18 is much longer than the travel of the actuator 44 due to the amplification resulting from the scissors 56. It is further contemplated that other types of actuators including, but not limited to, a motor driven screw mechanism could be substituted for the scissors mechanism 56.

The vent hood 18, which is mounted on the subframe 46, houses filters (not shown) through which the updraft heated air passes. A flexible duct 70 extends from the vent hood 18 and downwardly through the lift column 16 and into the island 10. The flexible duct thus raises and lowers with the lift column 16. The upper end of the duct 70 is secured in a collar or ring 72 in any convenient manner. The lower end of the duct 70 is connected to a filter assembly 74 to remove cooking vapors from the air. (The details of the filter assembly 74 are described in Applicant's co-pending application titled Modular Kitchen System filed Jun. 7, 2002, and incorporated herein by reference.) A blower 76 draws air through the duct 70 and filter 74 and discharges filtered air into an outlet duct 78. A humidifier 80 and heater 82 may optionally be provided in the outlet duct 78. The outlet duct 78 preferably discharges the filtered air for recycling back into the kitchen. Alternatively, the outlet duct 78 can be connected to an exhaust duct (not shown) in the floor to carry the vented air for discharge outside the house.

Controls are provided on the island for actuating the first stage actuator 30, the internal second stage actuators of the lift column frames 28, and the vent hood actuator 44. The various actuators can be positioned anywhere between the fully retracted and fully extended positions, such that the height of the assembly 14 is adjustable and the position of the vent hood 18 relative to the burners of the cooking surface 12 is adjustable. Thus, the vent hood 18 may cover only the rear burners, or may cover the rear burners and the front burners. Also, the height of the vent hood 18 above the cooking surface 12 can be selected to accommodate various cooking conditions.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A vent hood assembly for a kitchen cooking surface, comprising:

a column extending upwardly adjacent one side of the cooking surface at a non-perpendicular angle relative to the cooking surface and being adjustable between raised and lowered positions relative to the surface;

a vent hood mounted on the column and being horizontally movable between a retracted position behind the cooking surface and an extended position over the cooking surface.

2. The vent hood assembly of claim 1 wherein the column can be positioned at any height between the raked and lowered positions.

3. The vent hood assembly of claim 1 wherein the vent hood can be positioned anywhere between the extended and retracted positions.

4. The vent hood assembly of claim 1 wherein the vent hood includes a frame with scissor members for moving the hood between the extended and retracted positions.

5. The vent hood assembly of claim 1 wherein the vent hood includes an actuator for moving the hood between the extended and retracted positions.

6. The vent hood assembly of claim 5 further comprising a linear motion amplifier extending between the actuator and the vent hood so as to amplify movement of the actuator so as to impart greater movement to the vent hood.

7. The vent hood assembly of claim 5 wherein the actuator is mounted in the column, and further comprising linkage between the actuator and vent hood to translate upward and downward motion of the actuator into horizontal motion of the vent hood.

8. The vent hood assembly of claim 1 wherein the column includes telescoping sections.

9. The vent hood assembly of claim 1 wherein the column includes an actuator for moving the column between the raised and lowered positions.

10. The vent hood assembly of claim 1 wherein the angle between the column and the cooking surface is approximately 15° from vertical.

11. The vent hood assembly of claim 1 further comprising a vent duct connected to the vent hood and extending through the column.

12. The vent hood assembly of claim 1 wherein the vent hood is at least partially recessed beneath the cooling surface when the column is in the lowered position and the hood is in retracted position.

13. An island cooking station, comprising:

a stove top with a plurality burners;

a column extending upwardly and forwardly from the station and having vertical adjustability;

a vent hood mounted on the column and having horizontal adjustability;

the vent hood being movable between a plurality of operative positions over the burners and a position behind the stove top.

14. The cooking station of claim 13 wherein the vertical and horizontal adjustability are independent of one another.

15. The cooking station of claim 13 wherein the column includes telescoping sections.

16. The cooking station of claim 13 further comprising a vent duct extending from the vent hood and through the column.

17. The cooking station of claims 13 wherein the column extends approximately 15° from vertical.

18. The cooking station of claim 13 wherein the vent hood is moved horizontally by scissor members.

19. The cooking station of claim 13 wherein the vertical and horizontal movement of the vent hood is controlled by actuators.

20. The cooking station of claim 13 wherein the stove top is mounted on a cabinet, and further comprising a vent duct extending from the vent hood and into the cabinet.

21. The vent hood assembly of claim 13 comprising an actuator for controlling horizontal movement of the vent hood and further comprising a linear motion amplifier extending between the actuator and the vent hood so as to amplify movement of the actuator and thereby impart greater movement to the vent hood.

22. The vent hood assembly of claim 13 comprising an actuator for controlling horizontal movement of the vent hood and further comprising linkages extending between the actuator and the vent hood, so as to translate vertical movement of the actuator to horizontal movement of the vent hood.

23. The cooking station of claim 13 wherein the column and hood are retractable such that the hood is at least partially recessed behind the stove top.

* * * * *